US005988076A

United States Patent [19]

Vander Park

[11] Patent Number: 5,988,076

[45] Date of Patent: Nov. 23, 1999

[54] COMBINED CABLE MANAGER AND TABLE CONNECTOR

[75] Inventor: Antonius Adrian Vander Park, Caledon, Canada

[73] Assignee: Nova-Link Limited, Mississauga, Canada

[21] Appl. No.: 09/263,124

[22] Filed: Mar. 5, 1999

[51] Int. Cl.[6] ..... A47B 35/00

[52] U.S. Cl. ..... 108/50.02; 312/223.6

[58] Field of Search ..... 108/50.02, 50.01, 108/50.11, 64, 23; 312/223.6, 223.3, 249.9, 195, 245; 248/918

[56] References Cited

U.S. PATENT DOCUMENTS

| | | | |
|---|---|---|---|
| 2,943,897 | 7/1960 | Johnson et al. | 108/23 X |
| 3,538,862 | 11/1970 | Patriarca | 108/23 X |
| 4,658,577 | 4/1987 | Klein . | |
| 4,748,913 | 6/1988 | Favaretto et al. | 108/50.02 |
| 4,838,177 | 6/1989 | Vander Park . | |
| 4,840,023 | 6/1989 | Borsani . | |
| 4,852,500 | 8/1989 | Ryburg et al. | 108/50.01 X |
| 4,879,955 | 11/1989 | Moll et al. | 108/50.02 |
| 5,083,512 | 1/1992 | Newhouse et al. | 108/50.02 |
| 5,116,264 | 5/1992 | Wiederrich et al. | 108/23 |
| 5,163,281 | 11/1992 | Kanehira et al. . | |
| 5,174,223 | 12/1992 | Nagy et al. | 108/50.01 |
| 5,240,209 | 8/1993 | Kutsch . | |
| 5,443,312 | 8/1995 | Schluter | 312/249.9 X |
| 5,618,090 | 4/1997 | Montague et al. . | |
| 5,704,299 | 1/1998 | Corpuz, Jr. et al. . | |
| 5,752,449 | 5/1998 | Simon et al. | 108/50.02 |
| 5,824,957 | 10/1998 | Holshausen . | |
| 5,842,313 | 12/1998 | Murray et al. | 312/223.6 X |

FOREIGN PATENT DOCUMENTS

| | | | |
|---|---|---|---|
| 2207344 | 12/1998 | Canada . | |
| 169955 | 2/1986 | European Pat. Off. | 312/223.6 |
| 2839770 | 3/1980 | Germany | 312/223.6 |

OTHER PUBLICATIONS

NL/Systempac, Series III, vol. 2/96 the quarterly global review, Flexibility and Simplicity, 1996.

NL/Systempac, Furniture Solutions for the Intense Office, SIA Show, Jun. 4–6, 1996.

The quarterly global review, winter of 96.Series 2.25, 1996.

*Primary Examiner*—Jose V. Chen

*Attorney, Agent, or Firm*—Baker & Daniels

[57] ABSTRACT

A work station system suitable for an office can include an elongate support beam, rigid, vertical posts supporting this beam above the floor, and a movable desk unit with a work surface and rollable members mounted at a bottom end thereof A wall is mounted on the top of the beam in a vertical position and is supported by the beam. A flexible cable and wire carrier device extends between elevated positions on the support beam and the desk unit and is connected to both. Preferably this carrier device includes an elongate carrier section comprising a plurality of interconnected links that are pivotable with respect to each other. The carrier device permits the desk unit to move towards and away from the support beam and, if a desk unit which is vertically adjustable is connected to the carrier device, the carrier device also permits the desk unit to move upwardly or downwardly. The carrier device can include a connecting module attached to its beam end. The invention can also be used with a supporting wall that is supported directly by the floor and that has no beam member supporting it.

21 Claims, 7 Drawing Sheets

COMBINED CABLE MANAGER AND TABLE CONNECTOR

BACKGROUND OF THE INVENTION

This invention relates to work station systems suitable for offices, particularly such systems which employ elongate support beams and/or support walls that are mounted on the floor and that extend horizontally.

A variety of work station systems for use in offices and other work areas have been developed in recent years, many of these systems being designed for the purpose of using office space more efficiently. Because modern offices commonly require a considerable amount of electronic office equipment and cables and wires to operate and support same, modern office systems must be adapted to accommodate this type of equipment and must make it easy for workers and employees to use and operate this equipment in an efficient and effective manner. In addition, work station systems must take into account the need to have access to this electronic office equipment, including telephone units and the wires and cables for same, for the purpose of providing maintenance, repairs, and upgrades or changes to the equipment.

Work station systems suitable for an office which are based on an elevated, horizontal, structural beam support are known and used in the office furniture industry and these systems can be used to support electronic office equipment and phone systems. One such beam-type work station system is described in U.S. Pat. No. 4,838,177 issued Jun. 13, 1989 to Nova-Link Limited. This system is capable of mounting reasonably heavy electrical communication and computer equipment along the rear of a horizontal work surface. Support legs mount a beam of rectangular cross-section in a horizontal position above the floor while support brackets are detachably connected to one or both sides of the beam with the work surfaces being mounted on these brackets. Although this known work station system works reasonably well, the work surfaces provided by this system are not generally or easily adjustable or movable either in a horizontal direction or in a vertical direction.

Canadian patent application serial No. 2,207,344 filed Jun. 9, 1997 and assigned to Nova-Link Limited, describes and illustrates an improved beam-type work station system which not only employs a horizontal support beam and work surfaces mounted on at least one side of this beam, but also has a primary support wall capable of bearing reasonably heavy loads and mounted on top of the beam in a generally vertical position so as to be supported by the beam. This pending application also describes the use of a support wall extension which can be mounted on top of the primary support wall so as to increase the overall height of the support wall, which extension is detachable from the primary support wall. Preferably the primary support wall and any extension thereof have major surfaces thereof formed by metal panel members on which office equipment or shelves can readily be mounted by means of horizontally extending rails integrally formed on the panel members.

The aforementioned pending application also teaches the use of adjustable support brackets that can be mounted on one or both sides of the beam and that can be used to support not only electrically operated display screens and/or computer equipment but also horizontal work surfaces. However, although the support brackets are extendible to some extent in a horizontal direction, thereby moving the work surface outwardly away from the beam, any such adjustment does require some time and effort by the user or his or her equipment provider and therefore any such adjustment would only be carried out occasionally, possibly when the office was being reorganized or when new office equipment was required. Furthermore, this known system does not provide for any easy adjustment in the height of the work surface.

It is also known in the office furniture art to provide readily movable tables and desks, often by providing wheels or rollers mounted on the bottom of the furniture or at the bottom of the legs thereof. A recent example of a movable office desk with a keyboard support is that shown and described in U.S. Pat. No. 5,704,299 which issued Jan. 6, 1998 to Haworth. Inc. This keyboard support stand includes a support frame assembly and a height-adjustable top work surface that is divided into two side surfaces. The legs of the stand extend upwardly from two horizontal base members which can have a rollable caster mounted at one end thereof to facilitate repositioning of the stand. A support foot is mounted at the end of the base member located away from the caster. One known difficulty however with movable office furniture is that they may not be suitable for computer and/or communication equipment which can be quite delicate and easily damaged by movement. For this reason, it is generally desirable to mount such delicate equipment so that its position is substantially fixed.

Another problem with movable desks and tables is that, if electrical equipment is placed or mounted thereon, loose cables and wires for this equipment can be a problem and can even create a safety hazard. There is a clear need to reduce or avoid entirely any loose cables and wires and to properly provide for conducting same to the desk Devices such as protective sleeves and conduits for protecting and supporting electrical cable and wires are known in the cable and wire industry. For example, it is known to provide flexible, metal conduit which will protect wiring as well as persons and equipment located in the vicinity of this wiring. Rigid, metal pipes can also be used along walls to conduct and protect wiring and cable.

In particular, it is known to provide flexible, cable carriers for use in conjunction with large machine tools that have a moving machine component. One such cable carrier which is said to be self-supporting is taught in U.S. Pat. No. 4,658,577 which issued Apr. 21, 1987 to A & A Manufacturing Co., construction. Each segment has a generally rectangular cross-section with a hollow interior. The segments are pivotable with respect to each other a limited amount to form a flexible tube which fully encloses the cables or wires and supports same. The segments are preferably molded in one piece from a suitable plastic.

Also it is known in the modular office furniture art to provide rigid supporting walls that are mounted on the floor and not on a beam structure. Such walls can provide conduits for electrical wires and cables that are connected to office and computer equipment. Desk and shelving modules can be rigidly connected to these supporting walls.

SUMMARY OF THE INVENTION

An object of the invention is to provide a work station system suitable for an office which includes an elongate supporting structure and a movable desk unit mounted on rollable members wherein the desk unit is connected by a flexible cable and wire carrier device to the supporting structure and the desk unit itself is readily movable at least in a primary direction towards and away from the support beam.

Another object of the invention is to provide a highly flexible and utilitarian work station system for an office which includes a rigid, horizontally extending supporting arrangement and at least one movable desk unit with the desk unit or units being movably connected to the supporting arrangement by means of one or more flexible cable and wire carrier devices. In a preferred embodiment, each cable and wire carrier device includes an elongate carrier section made of a plurality of interconnected links that are pivotable with respect to each other.

According to one aspect of the invention, a work station system suitable for an office comprises an elongate rigid, horizontally extending supporting arrangement adapted for support on a floor, this arrangement including a wall structure that extends vertically, and a movable desk unit with a work surface thereon and rollable members mounted at a bottom end thereof. These members rollably support the desk unit near the supporting arrangement. A flexible cable and wire carrier device extends between the supporting arrangement and the desk unit and is connected to both. This carrier device includes an elongate carrier section comprising a plurality of interconnected links that are pivotable with respect to each other in a single, vertically extending plane. The carrier device permits the desk unit to move in a primary direction towards and away from the supporting arrangement and substantially prevents movement of the desk unit in a horizontal direction perpendicular to the primary direction.

Preferably, the desk unit includes a desk top section providing the work surface and the height of this desk top section is adjustable. The carrier device is connected to this desk top section.

According to another aspect of the invention, a work station system for an office comprises an elongate, rigid, horizontally and vertically extending supporting arrangement adapted for support on a floor, this arrangement being adapted for supporting electrically operated office equipment. A movable desk unit with a desk top section provides a work surface on top thereof and a flexible cable and wire carrier device extends between the supporting arrangement and the desk unit and is connected to both. The carrier device includes an elongate, flexible carrier section comprising a plurality of interconnected links that are pivtable to a limited extent with respect to each other. The carrier section provides protection for wires or cables extending therethrough during use of the carrier device and has a desk end and an opposite end, the desk end being connected to the desk unit at a connection point located a substantial distance above the floor. The carrier device permits the desk unit to move towards and away from the supporting arrangement to a limited extent.

According to a further aspect of the invention, a work station system suitable for office use includes an elongate horizontally and vertically extending supporting arrangement adapted for support on a floor, his arrangement including a support wall that extends vertically. The supporting arrangement supports computer equipment including a central processing unit At least one electronic display screen is mounted on the support wall and is operatively connected to the computer equipment. There is also a movable desk unit with a computer keyboard provided thereon, this keyboard being connected by wiring to the central processing unit. The desk unit includes rollable members mounted at a bottom end thereof and rollably supporting the desk unit near the supporting arrangement. A flexible cable and wire carrier device extends between the supporting arrangement and the desk unit and is connected to both. The wiring extends through this carrier and is protected thereby. The carrier device permits the desk unit to move towards and away from the supporting arrangement Again, the preferred cable and wire carrier device includes an elongate carrier section comprising a plurality of interconnected links that are pivotable with respect to each other.

Further features and advantages will become apparent from the following detailed description of a preferred embodiment taken in conjunction with the accompanying drawings.

DETAILED DESCRIPTION OF PREFERRED EMBODIMENT

Figure 1:
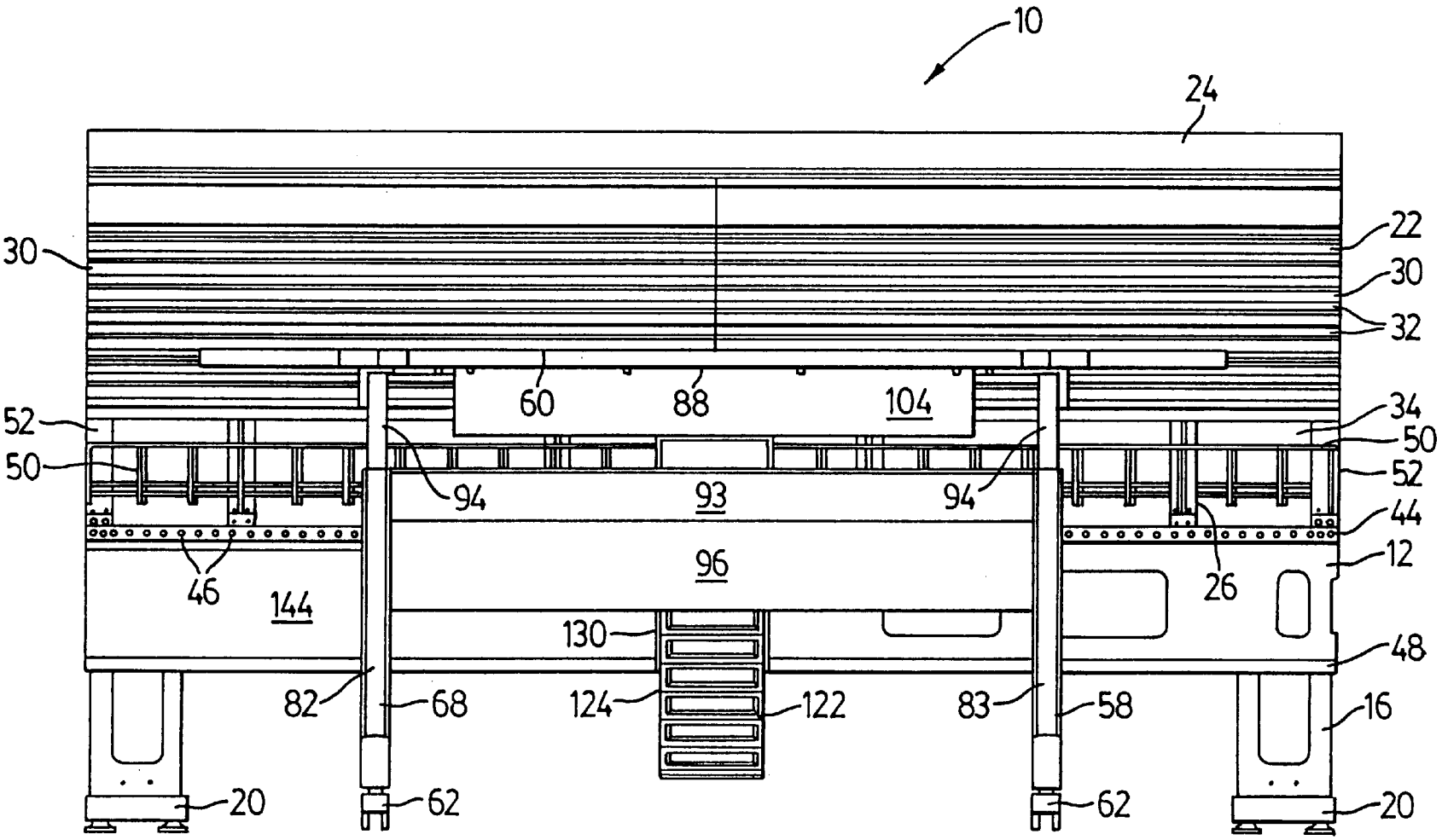
FIG. 1 is a front view of a work station system constructed in accordance with the invention.
Figure 2:
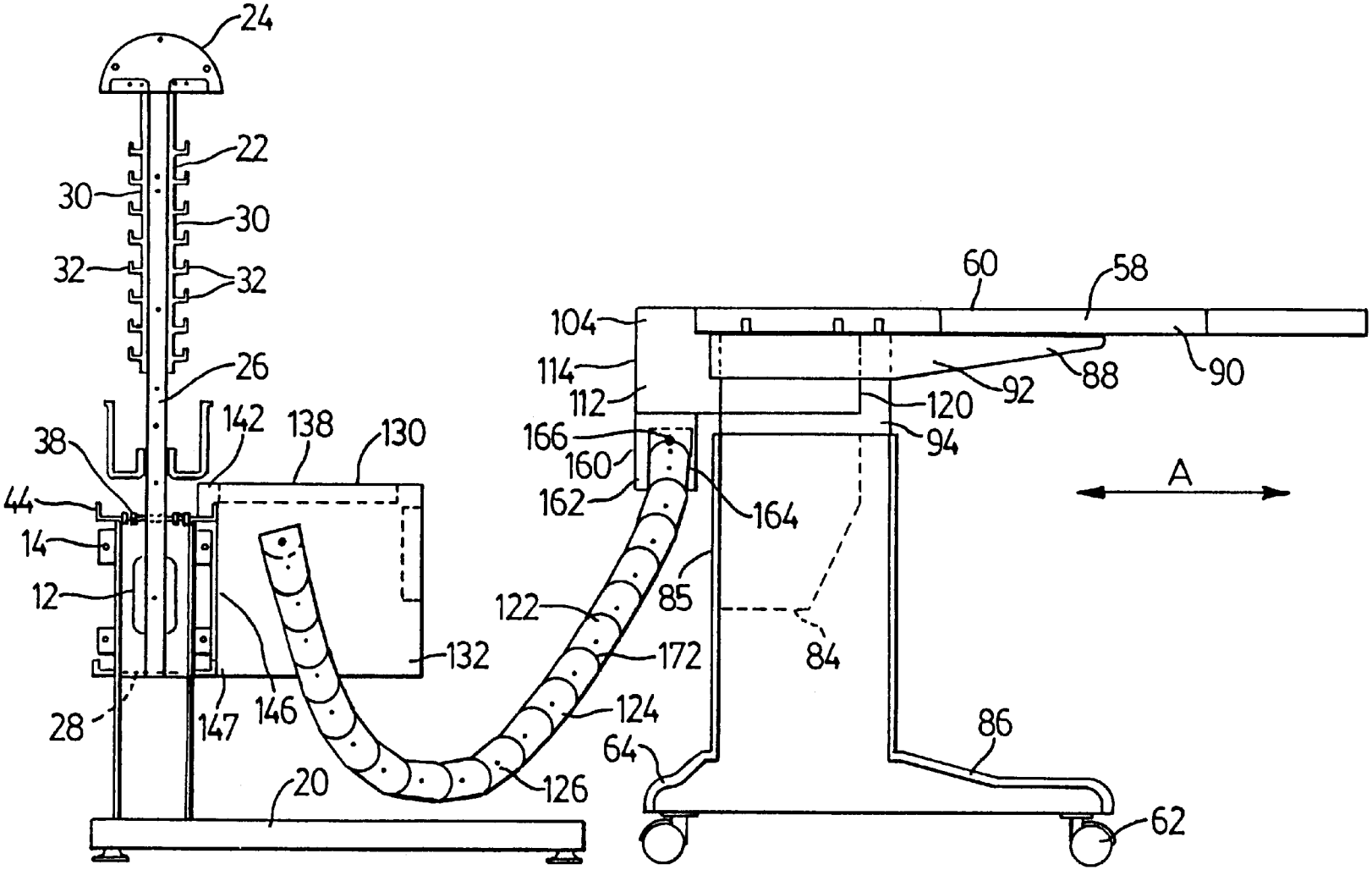
FIG. 2 is an end elevation of the work station system shown in FIG. 1.
Figure 3:
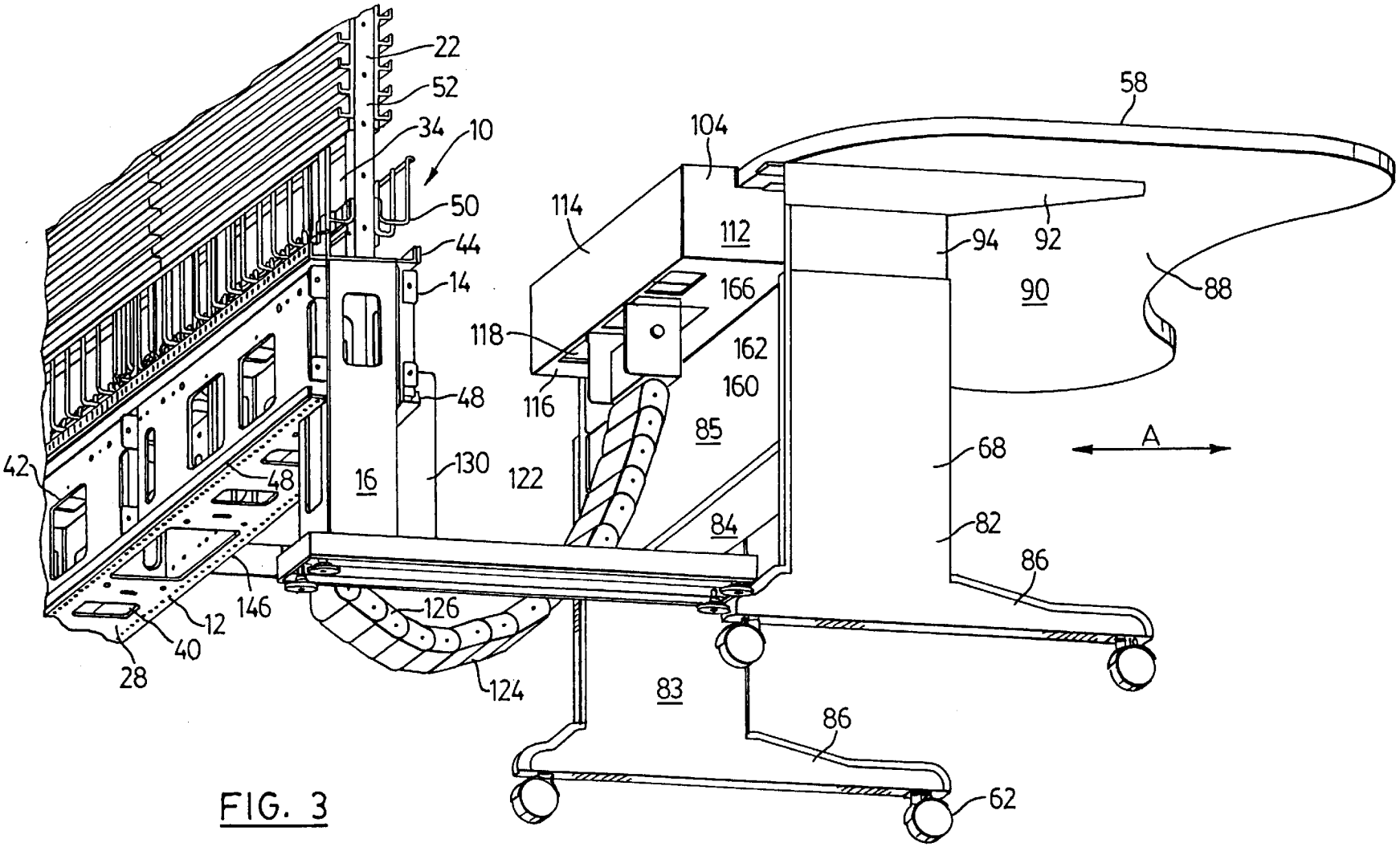
FIG. 3 is a perspective view of a work station system constructed in accordance with the invention, this view being taken from below and from the left end of the support beam with the beam and the support wall mounted on the beam shown only in part for ease of illustration.

FIGS. 1 to 3 illustrate the major components that in combination provide a work station system 10 constructed in accordance with the invention. This system includes an elongate support beam 12 which per se is of known construction and is similar, for example, to that disclosed in applicant's U.S. Pat. No. 4,838,177 and more recently the laid open Canadian application No. 2,207,344 mentioned previously. The disclosure of this patent application is incorporated by reference. The beam 12 can actually comprise a number of beam sections of standard length that can be connected end-to-end by means of end flanges 14 and bolts. The beam is supported by rigid, vertically extending supporting members or legs 16 a substantial distance above the floor, ie. about nine inches. The legs are connected to the beam for mounting same in a horizontal position above floor, indicated for instance at 18 in FIGS. 9 to 11. The legs are supported in an upright position by adjustable feet 20 that can extend in just one direction as shown in FIGS. 1 to 3 or in opposite directions from their respective legs. It will be understood that the top end of each leg fits into a suitable opening formed in the bottom of the adjacent beam section and the top end of the leg can be secured in the beam by means of suitable bolts and nuts. The top of the beam 12 is preferably no more than two feet above the floor and in a particularly preferred embodiment the top is only about 18 inches from the floor.

Extending upwardly from the beam is a primary support wall 22, also shown and described the Canadian application No. 2,207,344 mentioned previously. This wall is in a generally vertical position and can be provided with a rounded, decorative cap 24, if desired. The wall is solely supported by the beam 12 and each section of the wall is rigidly connected to the beam by means of vertically extending support columns or posts 26 which extend through openings formed in the top of the beam. The bottom ends of the columns 26 fit in slots or openings formed in a bottom plate 28 of the be (see FIG. 3). Extruded metal panels 30 of known construction are secured to opposite sides of the columns 26. Due to the rigidity of the columns 26 and the metal panels and the secure manner in which the columns are mounted, the support wall 22 and any similarly constructed extension of this wall is quite strong and rigid and can support shelving, support brackets and items of considerable weight, such as electrical equipment, mounted thereon. It should be noted that the electrical and computer equipment typically mounted on the beam and on the support wall is usually quite delicate and therefore unnecessary movement of this equipment is to be avoided whenever possible. Preferably therefore the position of this equipment should be fixed as it will be when mounted on the rigid beam or the support wall. The metal panels 30 can be made of extruded aluminum or aluminum alloy and each panel member is provided with a number of horizontal connecting rails 32. These rails can extend the entire length of each section of the wall and are preferably L-shaped in cross-section with an upwardly extending leg spaced from the outer or front surface of the panel member. The bottom edge of the lowermost panel member can be spaced some distance from the top of this support beam as shown, thereby leaving a relatively open space 34 between the top of the beam and the panel members for the passage of wires and cables. Of course, the support wall itself can be used to pass or conduct wiring and cables horizontally or vertically, if required.

Figure 4:
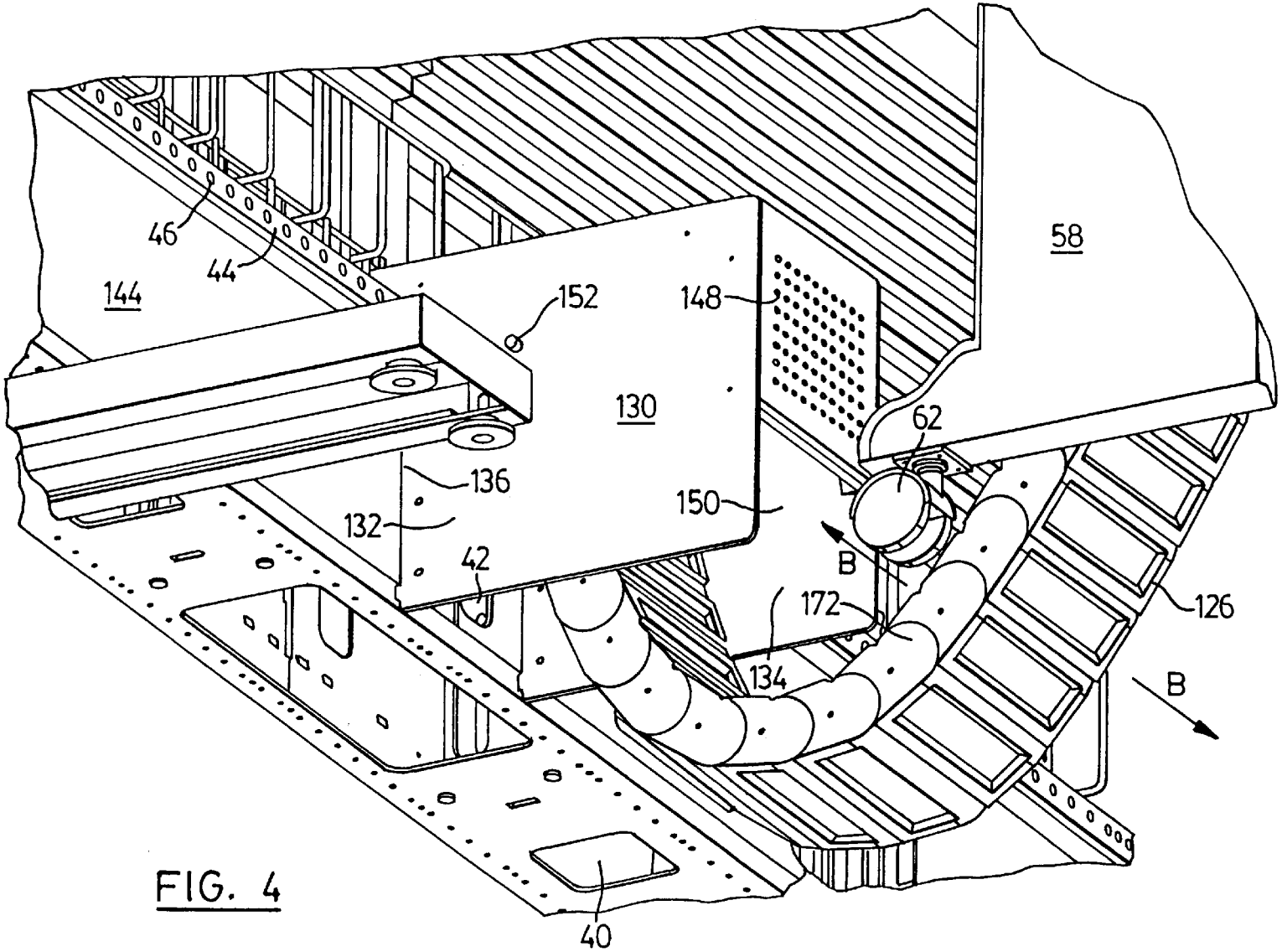
FIG. 4 is a perspective view showing portions of a support beam and support wall and a flexible cable and wire carrier device mounted on a side of the beam, this view being taken from below and from the left side.

Returning to the support beam 12, some features of this beam include the provision of upper access openings formed in a top plate 38 of the beam. Wires and cables can be inserted through or brought out through these openings, if desired. Similar rectangular, access openings 40 and 42 can also be provided in the bottom and two vertical sides of the beam as shown in FIGS. 3 and 4. Extending upwardly from opposite sides of the beam are strong, rigid connecting flanges 44 which can be provided with a series of bolt holes 46. Similar, upwardly extending L-shaped flanges 48 can also be provided along the bottom of the beam at each side, if desired.

An optional but preferred feature of this work station system is the provision of open meshed raceways 50 on both sides of the posts 26, these being attached by bolts to the posts and also to end columns 52 of the support wall. These raceways can be used to carry low voltage cable while high voltage cable which comes up through the floor and through the bottom of the beam is fed along the center of the hollow support beam 12.

It will be appreciated that the described work station structure including the support beam, the legs for supporting the beam above the floor, and the support wall form a rigid, horizontally extending supporting arrangement or spine suitable for at least one station and preferably for a number of work stations arranged on a floor area. This supporting arrangement can be laid out and constructed in a number of ways, depending upon the particular requirements for an office work site and it will be appreciated that this supporting arrangement is highly adaptable to the particular needs of a user. As indicated, it is also known in the office furniture art to make a similar rigid supporting arrangement or spine without the use of an elevated support beam. In these known systems, there is simply a supporting wall that extends up from the floor, that accommodates wiring and cables in its interior and that permits heavy electrical equipment to be mounted thereon. It will be understood that the present invention in its broadest aspects includes the use of supporting walls of this type.

The work station system 10 also includes at least one movable desk unit 58 as shown in FIGS. 1 to 3. Each desk unit 58 has a work surface 60 thereon and rollable members 62 mounted at a bottom end thereof and rollably supporting the desk unit near the supporting arrangement, including the beam 12. The rollable members preferably comprise either small wheels or casters and can be of known construction. Although four wheels are shown in the drawings, it is also possible to construct the desk unit with, for example, only two rollable members or wheels 62, these being located at the front end 64 of the base structure. If only two wheels at the front end are used, the rear end of the desk can simply be lifted by the user in order to move the desk unit inwardly or outwardly. The wheels or rollers are mounted on a suitable supporting base 68 shown in FIGS. 1 to 3. It is also possible to use a movable desk unit which has no wheels or casters, particularly if the floor is a hard, smooth surface and the desk unit itself is relatively light in weight. Such a light desk can be pushed back or forward as required, particularly if nothing heavy is resting on the desk.

The base section 68 has two vertical end panels 82, 83 which are joined together by a horizontal connecting panel 84 and a vertical back panel 85. Also connecting the two end panels 82, 83 are two vertically extending forward panels 93 and 96. Connected to the bottom of each panel 82, 83 or integrally formed thereon are horizontally extending foot sections 86 on which the wheels 62 are mounted. Slidably connected to the top of the panels 82, 83, is a desk top section 88 which provides the aforementioned work surface. The top section includes a generally flat, horizontal panel 90 to the bottom of which is connected two connecting brackets 92 which can be made of a metal such as steel. Extending downwardly from each bracket 92 is a vertical upper connecting panel 94 that extends into a slot formed in the top of its respective end panel 82 or 83. Any suitable known connecting means can be used to secure the desk top section 88 at the desired height once it has been moved to this height. Again, for example, nuts and bolts can be passed through suitable holes (not shown) in the end panels 82, 83 and the connecting panels 94 to prevent movement of these panels relative to one another. Although an adjustable desk unit is preferred, the present invention can also include the use of desk units having no adjustment capability, for example, no height adjustment.

The work surface of the desk unit can support the usual files, writing utensils and other office equipment normally placed on an office desk. In particular, the desk unit can have a computer key board 100 mounted or placed thereon, usually centrally on the desk top. An electrical cord 102 typically extends from this key board to a computer or central processing unit which can be mounted off the desk unit itself as described hereinafter.

The desk unit 58 is provided with an elongate cable and wire housing 104 that extends along the rear side of the desk unit, that is the side adjacent the support wall 22. This housing is hollow and one or more access openings 118 can be formed in a bottom 116 thereof as shown in FIG. 3. As shown the bottom 116 is located a substantial distance above the floor, for example, 2.0 to 2.5 feet assuming that the desk unit is in the normal position for sitting. The housing can be fitted with a movable top (not shown) in order to cover the wires and equipment therein. The size of this top will depend upon the particular requirements of the desk unit. For example, installed in the housing may be a standard phone equipment module such as the module 106 illustrated schematically in FIGS. 9 to 11. There may also, for example, be fitted into this chamber a calculator module or perhaps a small video display screen. Any area of the housing that is not filled with an equipment module such as these can be covered with a movable top panel in order to provide more desk area and in order to provide a very clean, finished appearance. Although one specific desk unit 58 has been illustrated, it will be appreciated that a variety of mobile desk units can be used with the present invention, the selected desk unit being designed to suit the specific project and equipment requirements.

The housing 104 projects rearwardly from the rear of the desk top as shown in FIGS. 2 and 3. This housing has two vertical end walls 112 and a rectangular rear wall 114. The housing has a front wall indicated at 120 in FIG. 2.

In addition to the rigid, horizontally extending supporting arrangement and the movable desk unit or units, the work station system 10 also includes a flexible cable and wire carrier device indicated generally at 122, this device extending between the support beam 12 and the movable desk unit 58 and connected to both, preferably at connection points well above the floor. The carrier device includes an elongate carrier section 124 comprising a plurality of interconnected links 126 that are pivotable with respect to each other, preferably in a single, vertically extending plane as shown in the drawings. The carrier device 124 permits the desk unit 58 to move in a primary direction indicated by arrow A in FIGS. 2 and 3 towards and away from the support beam 12 and at the same time substantially prevents movement of the desk unit in a horizontal direction perpendicular to this primary direction. The preferred carrier device serves several functions in addition to the basic purpose of conducting wires and/or cables from the support beam to the desk unit. It serves as a wire and cable organizer to prevent loose and/or separate cables and wires extending between the beam and the desk. It provides protection for the wire and cables that extend through it and reduces cable fatigue. Furthermore, because the amount of pivotal movement is generally limited, it can prevent the cable from being bent unduly or improperly when this is required to avoid damage to the cable.

The carrier device 122 illustrated in FIGS. 1 to 3 includes a connecting module 130 attached to the beam end of the flexible carrier section 124. As indicated by the dashed lines in FIGS. 2 and as shown more clearly in FIG. 4, an end section of the carrier section 124 is located within the module 130. The preferred illustrated module includes two opposite side walls 132, 134, each with a vertically extending edge 136 adapted to rest against a vertical side of the support beam 12 and a top wall 138 which optionally may be provided with an access opening, if desired. This preferred module also has two hook members 142 which can be an integral extension of each of the side walls and which are located at a top corner of the side walls. The hook members detachably engage the support beam and, in particular, one of the upwardly extending connecting flanges 44. To provide a very rigid and strong connection between the connecting module and the beam, the bottom corner 147 of each side wall 132, 134 is also preferably connected by means of bolts and nuts and suitable connecting brackets to the bottom of the edge of the beam. Incidentally, in a known manner, the adjacent side wall of the beam 12 can optionally be covered with a cover plate 144 in those regions of the beam where the access openings in the side of the beam are not in use. FIG. 4 shows the use of this cover plate to the left of the module 130 and shows the beam side without the cover plate on the right side of the module. For present purposes, this cover plate can be considered part of the support beam 12. If there is a cover plate, this plate would normally, but not necessarily, end approximately at the aforementioned vertical edge 136 of the module. Often the wires and cables exit the support beam through the top of the beam and not the side. In such cases, the cables can enter the module 130 from above.

The illustrated preferred module has a substantially open bottom through which the flexible carrier section 124 can extend and a substantially open end indicated at 146 (see FIGS. 2 and 3). This open end 146 is the end adjacent the support beam 12. The open bottom of the module allows the desk unit attached to the carrier section to move closer to the beam. In order to strengthen the rigidity of the module and to partially close the visible end thereof, the module preferably has a vertical front wall 148 which, as illustrated, is perforated and which extends only partway down the edge of the sidewalls 132, 134 leaving a frontal opening 150 through which the carrier section 124 can also extend, particularly when this section is stretched out by moving the desk unit outwardly away from the beam. The beam end of the carrier section 124 is pivotably connected to the module 130 by means of two strong pivot pins or bolts 152, one of which is shown in FIG. 4. A preferred form of bolt 152 is a shoulder bolt to provide the end section a degree of movement. The preferred pivot axis provided by the bolts 152 is a substantial distance above the floor. In the illustrated preferred embodiment, it is located at about the same level as the top of the beam, that is, about 18 inches above the floor. The elevated connection point helps to ensure that the carrier section, which preferably ranges between 36 inches and 60 inches in length has the required degree of slack so that the desk unit can be moved as required. It will be appreciated that the interior width of the module 130 is just slightly more than the width of the links 126 that together make up the carrier section. The construction of the carrier section, a preferred embodiment of which is described in more detail below, together with the restraint on the bending or twisting of this section imposed by the sides of the carrier module 130 helps to restrain the movement of the desk unit 56 or 58 so that it moves primarily in the direction indicated by the arrow A in FIGS. 2 and 3, that is, either directly towards or away from the support beam 12. The construction of the module 130 and the carrier section 124 helps to substantially prevent movement of the desk unit in a direction perpendicular to the primary direction, that is, it helps prevent movement of the desk unit in the direction indicated by the arrows B in FIG. 4.

As indicated, the support beam 12 has access openings 42 formed in one or both of the vertical, longitudinal sides thereof. The carrier device 122 is connected to the support beam 12 in the region of one of these access openings 42 whereby wires or cables extending along the interior passageway formed by the support beam are able to pass through the adjacent access opening and the elongate carrier section and out to the desk unit. Note also that the carrier device 122 and in particular the beam end of the carrier section are mounted a substantial distance above the floor. Preferably the pivot pin connection for the beam end of the carrier section is at least one foot and more preferably at least 1.5 feet above the floor level. This connection arrangement helps to provide the carrier section with the required degree of movement (slack) to permit the desk unit to move horizontally or vertically as desired.

Turning to the desk end of the carrier device 122, this end is preferably firmly connected to the cable and wire housing mounted along the rear of the desk top already described above. In this preferred embodiment, the desk end of the carrier section is pivotably connected to a channel shaped connector 160 that extends downwardly from the aforementioned housing but is a substantial distance above floor level (ie. about 2.0 feet). In the illustrated embodiment, this connector 160 is located in the center of the bottom 116 and is open at the rear. The connector has two vertical side walls 162 and a front wall 164 extending between these side walls. The connector is preferably made from sheet metal that has been bent to the required shape and size. It will be understood that an access opening into the cable and wiring housing is provided directly above the channel shaped connector 160 so that wires and cables passing through the carrier device can readily pass into the housing. The desk end of the carrier section 124 is connected by mean of one or two strong pivot pins or bolts 166 to the side walls 162. Again, the internal width of the connector 160 is just slightly greater than the width of the links that make up the carrier section 124 and thus the side walls 162 act to guide the pivoting movement of the end links and help to prevent twisting of the carrier section as the desk unit is moved. Again, because of the height of the pivot axis provided by the bolts 166 and the end of the carrier section attached thereto, the carrier section is provided with the required slack to permit the desk unit to move as required. The carrier device is preferably constructed and mounted to not restrict movement of the mobile desk unit towards the support beam and support wall. In one preferred embodiment, this pivot axis is about 29–30 inches above the floor with the desk top in the normal position for sitting. The preferred range for the height of this pivot axis above the floor is between 2 and 2.5 feet. The preferred work station system of the invention is constructed so that the carrier section 124 stays off the floor. This can be accomplished by controlling the length of the carrier section and the height at which its ends are mounted.

Figure 8:
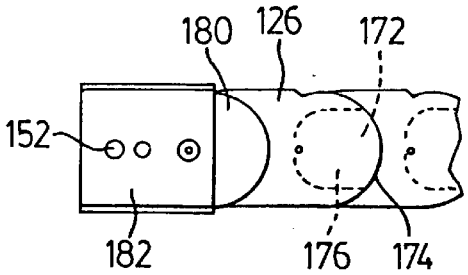
FIG. 8 is a detail view showing a preferred construction for an end section of the carrier device.

The preferred construction of the links which make up the carrier section 124 is illustrated in FIGS. 1, 4 and 8. The preferred links 126 are generally uniform in their construction. The links can be constructed in the same manner as the links of the cable carrier sold under the trademark "GORTRAC NYLATUBE". Each link is formed with a semicircular end section 172 on two opposite sides thereof. This end section fits into a cooperating semicircular recess 174 formed in the adjacent end of the next link. One suitable form of cable carrier is described in detail in U.S. Pat. No. 4,658,577 of A & A Manufacturing Co., Inc. Briefly, each link has a generally rectangular transverse cross-section and has a hollow interior through which cables and wires can readily pass. The sections are pivotable with respect to each other a limited amount to form a flexible tube that is able to bend in a single plane. The cable or conductors are fully enclosed while being supported by the cable carrier. Each link can be molded from a single piece of suitable plastic material which should be sufficiently strong to withstand normal stress forces applied to it by the movable desk unit. If desired, the links can be made with a dividing wall in order to form two separate passageways, for example, one for high voltage cable and the other for low voltage wiring.

Extending forwardly from the arcuate recess 174 on each side of the link is a coupling member 176 outlined in dashed lines in FIG. 8. The outer surface of each coupling member is provided with a recess which is configured to receive a complimentary boss formed on the inner wall of the adjacent link. These bosses can pivot within their respective recesses. Each plastic end link 180 can be secured in a suitable connecting bracket 182 on which the pivot pins or bolts can be securely mounted. It is these pivot bolts 152 which pivotably connect the carrier section to the module 130.

Figure 6:
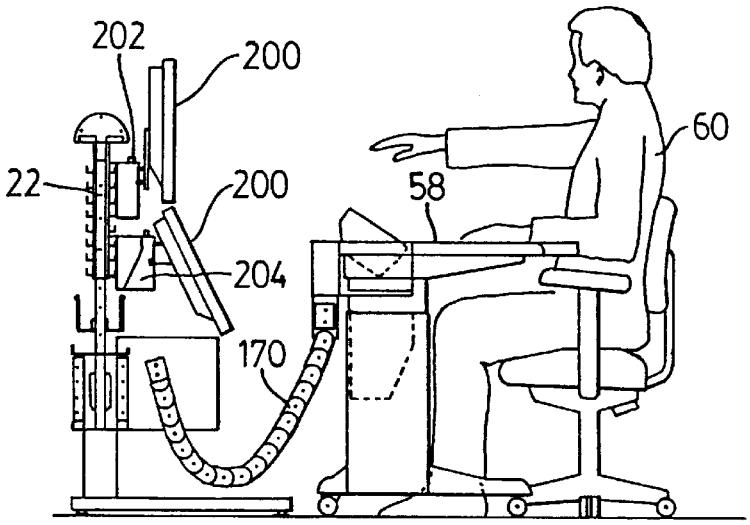
FIG. 6 is an elevational schematic view illustrating a work station with two LCD display units mounted on a support wall and a movable desk unit lowered to sitting height.

Turning now to the illustrations of FIGS. 6, 7 and 9 to 11, FIGS. 6 and 7 shown how a work station system constructed in accordance with the invention can be used both in a sitting position (FIG. 6) and in a standing position. In the sitting position, the top section of the desk unit 58 has been lowered. In this position the sitting user 60 of the system can readily type on a keyboard located on the work surface of the desk. The user is also able to observe two liquid crystal display units or screens 200. These units 200, which are quite heavy for their size, are mounted on and supported by a side of the support wall 22. Liquid crystal display units of this type are of known construction and therefore a detailed description thereof in the present application is deemed unnecessary. A suitable pivoting support bracket 202 or 204 can be used to connect the display unit to the metal side panel of the support wall and, in particular, to the connecting flanges formed thereon. The upper display unit 200 as shown in FIG. 6 is directly in front of the user's head along a generally horizontal sight line. The lower display unit 200 is tilted at an angle to the vertical in order that its display screen can be readily seen as well by the same user 60.

Figure 7:
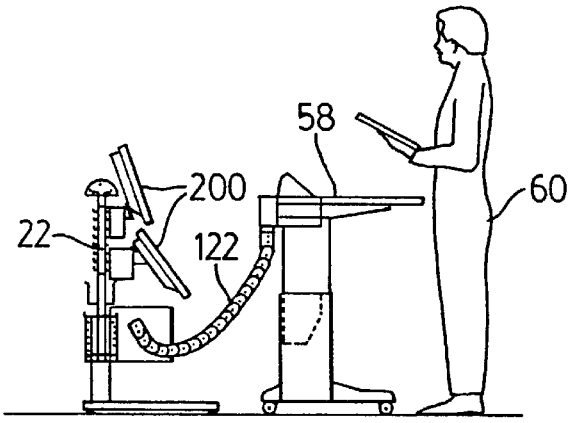
FIG. 7 is an elevational view similar to FIG. 6 but showing the desk unit raised to a height suitable for a user who is standing.

Turning to FIG. 7, the desk unit 58 is shown in an elevated position suitable for a user 60 who is standing up. It will be seen that the user standing in front of the desk unit is still able to see quite readily both of the liquid crystal display units 200. Note that the top section of the desk unit 50 can be raised quickly and easily to the position shown in FIG. 7 since the wires and cables that extend through the carrier device 122 do not need to be disconnected and then reconnected again after the top section has been raised. It is also very easy for the user to move the desk unit inwardly or outwardly relative to the support beam and the support wall because of the highly flexible connection that exists between the two components.

Figure 9:
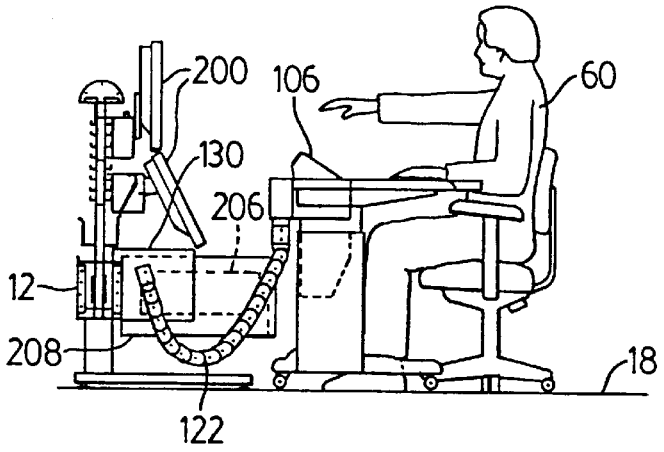
FIG. 9 is a schematic elevational view showing a work station with a horizontal CPU mounted on the beam and two LCD displays mounted at different levels on the support wall.
Figure 10:
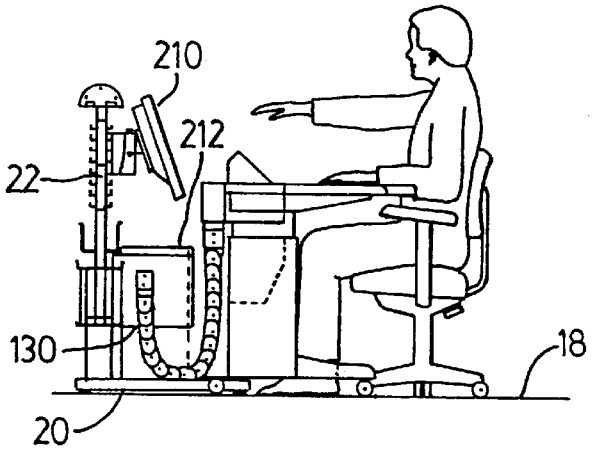
FIG. 10 is a schematic elevational view showing a computer or central processing unit that extends vertically and is mounted on a side of the beam and behind movable desk unit.
Figure 11:
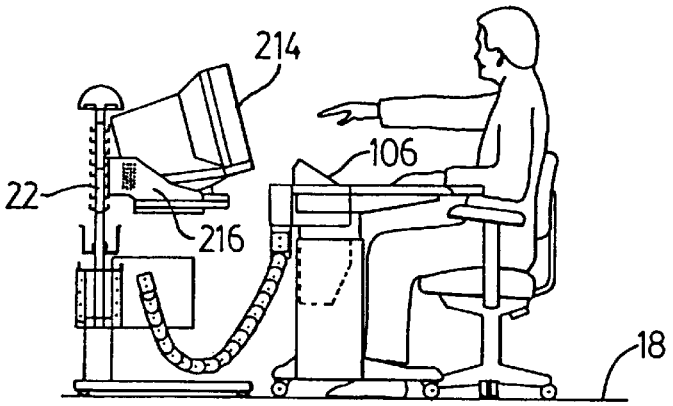
FIG. 11 is another schematic elevational view, this one showing how a CRT display unit can be mounted on the support wall behind the movable desk unit.

Turning now to the arrangements illustrated in FIGS. 9 to 11 wherein the user 60 is seated, these drawings illustrate various forms of display units or display devices that can be mounted on the support wall and further show how a computer or central processing unit can be mounted on or adjacent to the support beam and away from the movable desk. In the work station shown in FIG. 9 there are again two liquid crystal display units 200 mounted one above the other. Directly below the bottom display unit and mounted to the side of the support beam 12 is a horizontally extending central processing unit 206 outlined in dashed lines. This computer can be of standard, well known construction and accordingly a further description thereof is deemed unnecessary. The computer can be housed in a suitable computer housing 208 which can also be of known construction and which has connectors on its beam side for rigidly connecting the housing to a vertical side of the support beam. In this case the housing 208 would be mounted either to the left or to the right of the connecting module 130 for the carrier device 122. It is also possible to mount the connecting module 130 on the support wall 22 above the housing 208. Because the CPU and the display screens are mounted on the support structure which is separate from the desk unit, the desk unit itself is not required to bear or support relatively heavy loads and this helps to enhance the mobility of the desk unit as well as making more desk space available. The display screens will normally be electrically connected to and operated by the CPU 206.

Referring to FIG. 10, this illustration shows a single liquid crystal display unit 210 pivotably mounted on the support wall 22 at a location which is readily visible from a seating position at the front of the desk unit. Mounted next to and on the support beam is a vertically extending computer or CPU 212 which can be a standard "tower type" computer. The CPU extends parallel to the vertical side of the support beam and to the support wall and is mounted on the beam by suitable known brackets or by means of a support housing attached to the side of the beam. Again, the computer can be positioned either to the left or to the right of the connecting module 130 for the carrier device or, if the module is mounted on the support wall, the computer can be located below this module. Although it is possible to have the computer simply sit on the office floor in approximately the position shown in the drawing, it can be mounted on the side of the support beam using suitable brackets.

The arrangement illustrated in FIG. 11 is similar to that shown in FIG. 6 except that instead of liquid crystal display screens, a single television monitor, or computer monitor (also known as a CRT, which is an acronym for cathode ray tube), indicated at 214 is mounted at about desk top height on the support wall 22. The monitor can rest on a horizontal shelf connected to the support wall by two supporting brackets 216. As the construction of these supporting brackets and the support shelf is known in the modular office furniture art, a detailed description thereof is deemed unnecessary herein. It will be recognized that the video monitor 214 has a significant weight and some work stations may be provided with two or more of these monitors. Thus, by removing this weight from the desk unit and having these monitors supported by the separate support wall, the desk unit remains easily movable by a user and can be readily raised or lowered.

Figure 5:
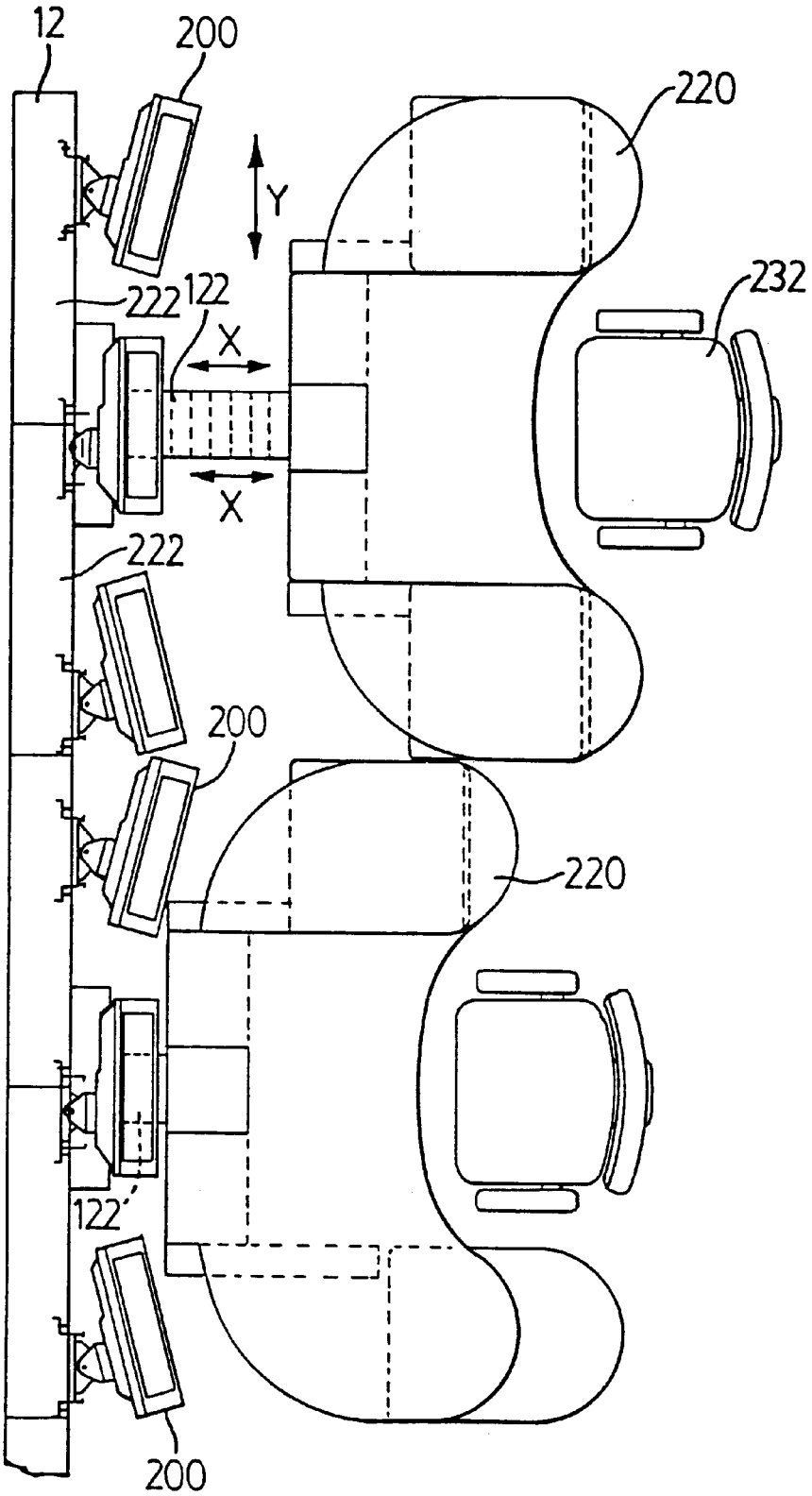
FIG. 5 is a schematic plan view showing how two similar movable desk units can be arranged side-by-side and movably connected to a single elongate beam structure.

Turning to FIG. 5, this plan view shows how two movable desk units 220 can be arranged in a substantially side-by-side manner. These desk units are similar in their construction (for present purposes) as the desk unit 58 shown in FIGS. 1 to 3. The two units are arranged on one side of a long support beam 12 (shown only schematically) which comprises a number of support beam sections 222 of uniform length, for example, four feet. Mounted on the support wall above the support beam are a number of LCD display units 200. As illustrated, there are three of these LCD units for each of the two desk units 220 with one LCD display mounted directly in front of each user, another unit mounted to the left and a third unit mounted to the right. Also illustrated schematically in FIG. 5 is the carrier device 122 that connects each desk unit 220 to the support beam 12. FIG. 5 illustrates how the preferred carrier device 122 is able to guide the movement of each desk unit in the primary direction (indicated by the arrows X) towards and away from the support beam. Because the carrier device will only pivot in a single vertical plane, the device 122 substantially prevents movement of each desk unit 220 in a horizontal direction indicated by the arrow Y, this direction being perpendicular to the primary direction of movement. It will thus be seen that this guidance provided by the carrier device helps to prevent one desk unit from colliding with another desk unit or interfering with the back and forth movement of the adjacent desk unit. It is also possible in some versions of the invention to use a carrier device that can pivot in a full 360 degree circle of movement at least to a limited extent. Such carrier devices are already known in the cable carrier art and therefore a description thereof is deemed unnecessary herein. One such cable carrier is taught in U.S. Pat. No. 5,824,957 issued Oct. 20, 1998. Another carrier guide with two-directional joints is taught in earlier U.S. Pat. 4,840,023 issued Jun. 20, 1989. With the use of these multi-directional carrier devices, the desk units connected thereto can move in more than one horizontal direction including sideways. This may not be a problem if the desk unit is spaced a good distance from other desk units. In the alternative, other means could be provided for guiding the movement of the desk unit such as guide tracks on the floor or guiding surfaces arranged beside the desk unit (i.e. an adjacent desk, table or desks that are fixed in their own position).

It will be appreciated by those skilled in this art that various modifications and changes can be made to the described work stations and systems without departing from the spirit and scope of this invention. For example, instead of using a rigid support wall on top of the support beam as shown, it is also possible to provide simply a divider wall that extends vertically above the beam. This wall may have cloth covered sides, for example, and be provided simply for privacy purposes and/or acoustical reasons. The use of such a wall may be possible if it is not necessary to mount relatively heavy equipment such as monitors, etc. on the wall. Accordingly, all such modifications and changes as fall within the scope of the appended claims are intended to be part of this invention.

We claim:

1. A work station system suitable for an office comprising:

an elongate, rigid, horizontally extending supporting arrangement adapted for support on a floor, said arrangement including a wall structure that extends substantially vertically;

a movable desk unit with a work surface thereon and rollable members mounted at a bottom end thereof and rollably supporting said desk unit near said supporting arrangement;

a flexible cable and wire carrier device extending between said supporting arrangement and said desk unit and connected to both, said carrier device including an elongate carrier section comprising a plurality of interconnected links that are pivotal with respect to each other in a single vertically extending plane, wherein said carrier device permits said desk unit to move in a primary direction towards and away from said supporting arrangement and substantially prevents movement of said desk unit in a horizontal direction perpendicular to said primary direction.

2. A work station system according to claim 1 wherein said supporting arrangement includes an elongate support beam and rigid, vertically extending supporting members connected to said beam for mounting said beam in an elevated position above the floor, said wall structure is mounted on top of said beam, and said carrier device extends between said support beam and the desk unit.

3. A work station system according to claim 1 wherein said desk unit includes a desk top section providing said work surface, the height of said desk top section is adjustable, and said carrier device is connected to said desk top section.

4. A work station system according to claim 2 wherein said carrier device includes a connecting module attached to one end of said carrier section, said module having two opposite side walls, each with a vertically extending edge adapted to rest against a side of said support beam, and hook members to detachably engage said support beam.

5. A work station system according to claim 4 wherein said connecting module has a substantially open bottom through which said carrier section can extend and a substantially open end at an end thereof adjacent said support beam.

6. A work station system according to claim 2 wherein said support beam has a number of access openings formed in at least one longitudinal side thereof and said carrier device is connected to said support beam in the region of one of said access openings, whereby wires or cables extending along an interior passageway formed by said support beam are able to pass through said one access opening and said elongate carrier section to said desk unit.

7. A work station system according to claim 2 wherein said elongate carrier section is connected to a cable and wire housing provided along a rear side of said desk unit, said housing forming a chamber for wiring and having one or more wire access openings formed in a bottom thereof and wherein said bottom of the housing is spaced a substantial distance above the floor.

8. A work station system according to claim 2 wherein said elongate carrier section is pivotably connected to a channel shaped connector provided on a rear side of said desk unit whereby an adjacent end of said carrier section can pivot about a horizontal pivot axis relative to said connector, said channel shaped connector having two vertical sidewalls on opposite sides thereof and a front wall extending between said sidewalls, and wherein said horizontal pivot axis is positioned at least two feet above the floor.

9. A work station system according to claim 2 wherein said wall structure is a supporting wall with metal side panels forming major sides thereof and said supporting wall is capable of bearing electrically operated office equipment thereon.

10. A work station system for an office comprising:

an elongate, rigid, horizontally and vertically extending supporting arrangement adapted for support on a floor, said supporting arrangement being adapted for supporting electrically operated office equipment;

a movable desk unit with a desk top section providing a work surface on top thereof, and a flexible cable and wire carrier device extending between an elevated connection point on said supporting arrangement and said desk unit and connected to both said supporting arrangement and said desk unit, said carrier device including an elongate, flexible carrier section comprising a plurality of interconnected links that are pivotable to a limited extent with respect to each other, said carrier section providing protection for wires or cables extending therethrough during use of said carrier device and having a desk end and an opposite end, the desk end being connected to said desk unit at a connection point located a substantial distance above the floor, wherein said carrier device permits said desk unit to move horizontally towards and away from said supporting arrangement to a limited extent.

11. A work station system according to claim 10 wherein said supporting arrangement includes an elongate, horizontal support beam and rigid, vertically extending supporting members connected to said beam and supporting said beam a substantial distance above said floor, and said carrier device extends between the support beam and the desk unit and is firmly connected to said support beam.

12. A work station system according to claim 11 wherein said support beam is supported a distance of at least nine inches above the floor and said connection point for the desk end of the carrier section is at least 2.0 feet above the floor.

13. A work station system according to claim 10 wherein the height of said desk top section is adjustable, and said carrier device is connected to said desk top section.

14. A work station system according to claim 11 wherein said supporting arrangement includes a support wall capable of bearing relatively heavy electrical equipment and mounted on top of the horizontal support beam, said support wall including metal side panels with means for attaching said electrical equipment to the support wall provided thereon.

15. A work station system according to claim 14 wherein at least one liquid crystal display screen is mounted on said support wall and at least one central processing unit is mounted on said support beam, the or each central processing unit being operatively connected to one respective liquid crystal display screen.

16. A work station system suitable for office use comprising:

an elongate, horizontally and vertically extending supporting arrangement adapted for support on a floor, said supporting arrangement including a support wall that extends vertically, said supporting arrangement supporting computer equipment including a central processing unit;

at least one electronic display screen mounted on said support wall and operatively connected to said computer equipment;

a movable desk unit with a computer keyboard provided thereon and connected by wiring to said central processing unit, said desk unit including rollable members mounted at a bottom end thereof and rollably supporting said desk unit near said supporting arrangement; and a flexible cable and wire carrier device extending between said supporting arrangement and said desk unit and connected to both, said wiring extending through said carrier and protected thereby, wherein said carrier device permits said desk unit to move towards and away from said supporting arrangement.

17. A work station system according to claim 16 wherein said supporting arrangement includes at least one elongate support beam and rigid, vertically extending legs connected to said at least one beam for mounting said at least one beam in an elevated horizontal position above the floor, said at least one beam supports said computer equipment including said central processing unit, and said support wall is mounted on top of said at least one beam.

18. A work station system according to claim 17 wherein said cable and wire carrier device includes an elongate carrier section comprising a plurality of interconnected links that are pivotal with respect to each other, said interconnected links being pivotable in a single, substantially vertical plane and said carrier device permitting said desk unit to move in a primary horizontal direction towards and away from said supporting arrangement and substantially preventing movement of the desk unit in a horizontal direction perpendicular to said primary direction.

19. A work station system according to claim 16 wherein said movable desk unit includes a desk top section with a work surface, the height of said desk top section is adjustable, and said carrier device is connected to said desk top section at a connection point located a substantial distance above the floor.

20. A work station system according to claim 18 wherein said carrier device includes a connecting module attached to one end of said carrier section, said module having two opposite sidewalls each with a vertically extending edge adapted to rest against a vertical side of one support beam and hook members to detachably engage said one support beam, and wherein said one end of said carrier section is located a distance of at least about 1.5 feet above the floor.

21. A work station system according to claim 19 wherein said connection point on the desk top section is at least two feet above the floor and said at least one beam is mounted at least nine inches above the floor.

* * * * *